US009980030B2

(12) United States Patent
Nenonen et al.

(10) Patent No.: US 9,980,030 B2
(45) Date of Patent: May 22, 2018

(54) BLUETOOTH WIRELESS HEADPHONE BRACELET

(71) Applicant: Ashley Chloe Inc., Santa Clara, CA (US)

(72) Inventors: Mika Nenonen, Helsinki (FI); Anson Liang, Santa Clara, CA (US); Hyon Bae, Oakland, CA (US); Angela Pan, Santa Clara, CA (US); Xing Guangxin, Shenzhen (CN)

(73) Assignee: Ashley Chloe, Inc., Santa Clara, CA (US)

( * ) Notice: Subject to any disclaimer, the term of this patent is extended or adjusted under 35 U.S.C. 154(b) by 0 days. days.

(21) Appl. No.: 15/179,790

(22) Filed: Jun. 10, 2016

(65) Prior Publication Data

US 2016/0373850 A1 Dec. 22, 2016

Related U.S. Application Data

(60) Provisional application No. 62/180,492, filed on Jun. 16, 2015.

(51) Int. Cl.

| | |
|---|---|
| ***H04R 25/00*** | (2006.01) |
| ***H04R 1/10*** | (2006.01) |
| ***H04R 1/02*** | (2006.01) |

(52) U.S. Cl.

CPC ..... *H04R 1/1016* (2013.01); *H04R 1/028* (2013.01); *H04R 1/1033* (2013.01); *H04R 2201/029* (2013.01); *H04R 2420/07* (2013.01)

(58) Field of Classification Search

CPC .... H04R 1/1016; H04R 1/028; H04R 1/1033; H04R 2201/029; H04R 2420/07

See application file for complete search history.

(56) References Cited

U.S. PATENT DOCUMENTS 5,636,775 A * 6/1997 Kartsotis ..... A44C 5/003 224/267
6,314,184 B1 11/2001 Fernandez-Martinez
7,761,091 B2 * 7/2010 Dunn, Jr. ..... H04R 1/1041 455/575.2

(Continued)

FOREIGN PATENT DOCUMENTS

CN 102647644 A 8/2012
CN 202998403 A 6/2013

(Continued)

OTHER PUBLICATIONS

Batuhanesirger, "Earphone Wrapped Bracelet", Mar. 3, 2015 [online], [retrieved on Aug. 22, 2016]. Retrieved from the Internet: <URL:https://web.archive.org/web/20150303182429/http://www.cgtrader.com/3d-pring-models/gadgets/audio/earphone-wrapper-bracelet> Entire document, especially Fig. 2, Fig. 4.

(Continued)

*Primary Examiner* — Brian Ensey
(74) *Attorney, Agent, or Firm* — Haverstock & Owens LLP

(57) ABSTRACT

The present invention comprises a combination of a bracelet and a Bluetooth wireless headphone. The Bluetooth headphone is stored inside the bracelet, and the bracelet can be worn on the wrist of the user. The Bluetooth headphone has two small earbuds with high sound quality speakers inside.

12 Claims, 6 Drawing Sheets

(56) References Cited

U.S. PATENT DOCUMENTS

| | | | | |
|---|---|---|---|---|
| 8,534,514 | B2 * | 9/2013 | Zhu | A45F 5/00 224/267 |
| 9,265,310 | B2 * | 2/2016 | Lam | H04M 1/0256 |
| 9,662,015 | B2 | 5/2017 | Proud | |
| 2013/0243236 | A1 * | 9/2013 | Chamness | H04R 1/10 381/378 |
| 2014/0116085 | A1 | 5/2014 | Lam | |
| 2016/0126659 | A1 * | 5/2016 | Kim | H04R 1/1066 264/138 |
| 2017/0113059 | A1 | 4/2017 | Fisher | |

FOREIGN PATENT DOCUMENTS

| | | | | |
|---|---|---|---|---|
| JP | 2006074384 | A * | 3/2006 | H04R 1/10 |
| WO | 2012153359 | A1 | 11/2012 | |

OTHER PUBLICATIONS

Ashley Chloe, "HELIX: Wearable Cuff with Stereo Bluetooth Headphones (With Interviews)", Jul. 20, 2015 [online], [retrieved on Aug. 22, 2015]. Retrieved from the internet: <URL:http://www.youtube.com/watch?v=pgQivkATIM> Entire document.

Edgar Cervantes, "Helix Bluetooth headphones can be worn in a fashionable cuff", Jul. 20, 2015 [online], [retrieved on Aug. 22, 2016]. Retrieved from the internet; <URL:http://www.androidauthority.com/helix-bluetooth-headphones-fashion-cuff-62088/> Entire document.

International Preliminary Report on Patentability from PCT Application No. PCT/US2016/037064.

* cited by examiner

BLUETOOTH WIRELESS HEADPHONE BRACELET

CROSS-REFERENCE TO RELATED APPLICATION(S)

This application claims priority under 35 U.S.C. § 119(e) of the U.S. Provisional Patent Application Ser. No. 62/180,492, filed Jun. 16, 2015 and titled, "Bluetooth Wireless Headphone Bracelet," which is also hereby incorporated by reference in its entirety for all purposes.

FIELD OF THE INVENTION

The present invention relates to the field of consumer electronics. More specifically, the present invention relates to wireless headphones.

BACKGROUND OF THE INVENTION

Typical headphones have loose cables, which cause troubles in carrying and transportation. People generally need to carry a separate case for storing the headphones.

SUMMARY OF THE INVENTION

In some embodiments, the present invention comprises a combination of a bracelet and a Bluetooth wireless headphone. In some embodiments, a Bluetooth headphone is stored inside the bracelet, and the bracelet can be worn on the wrist of the user. In some embodiments, the bracelet is an accessory that the user is able to wear everyday, which is fashionable and fits to the personal style of the user. In some embodiments, a Bluetooth headphone has two small earbuds with high sound quality speakers inside.

In an aspect, a wireless headphone container comprises a bracelet and a wireless headphone having earbuds and one or more cables configured to fit into an opening of the bracelet. In some embodiments, the opening comprises a first cavity and a second cavity. In other embodiments, the first cavity is at a proximal end of the bracelet and the second cavity is at a distal end of the bracelet. In some other embodiments, the bracelet comprises a channel connecting the first cavity and the second cavity. In some embodiments, the channel is configured to have a size for storing a cable. In other embodiments, the first cavity has a shape matches a shape of a control unit of the headphone. In some other embodiments, the second cavity has a shape structured to store the earbuds.

In another aspect, a wearable electronic device comprises a container wearable on a wrist and an audio unit configured to be stored in the container. In some embodiments, the audio unit comprises a headphone. In other embodiments, the headphone comprises a Bluetooth headphone. In some other embodiments, the audio unit is stored inside the container, such that the audio unit is invisible when stored. In some embodiments, the container comprises a bracelet. In some other embodiments, the container comprises a first cavity having a shape for storing a control unit. In some other embodiments, the container comprises a second cavity having a shape for storing two earbuds. In some embodiments, the container comprises a body in a loop structure. In some other embodiments, the loop structure is able to be pulled to open. In some other embodiments, the loop structure comprises two ends form an overlapping section at a close state.

In another aspect, a method of making a wearable headphone comprises forming a container wearable on a wrist, forming a headphone, and storing the headphone in the container. In some embodiments, the method further comprises forming at least two cavities and a slit on the container. In other embodiments, the one of the at least two cavities has a shape for storing a control unit. In some other embodiments, the other of the at least two cavities has a shape for storing earbuds. In some embodiments, the slit has a shape for storing an audio cable.

Other features and advantages of the present invention will become apparent after reviewing the detailed description of the embodiments set forth below.

BRIEF DESCRIPTION OF THE DRAWINGS

Embodiments will now be described by way of examples, with reference to the accompanying drawings which are meant to be exemplary and not limiting. For all figures mentioned herein, like numbered elements refer to like elements throughout.

Figures attached illustrate a construction and a use of the bracelet and the Bluetooth wireless headphone in accordance with some embodiments of the present invention.

DETAILED DESCRIPTION OF THE PREFERRED EMBODIMENT

Reference is made in detail to the embodiments of the present invention, examples of which are illustrated in the accompanying drawings. While the invention is described in conjunction with the embodiments below, it is understood that they are not intended to limit the invention to these embodiments and examples. On the contrary, the invention is intended to cover alternatives, modifications and equivalents, which can be included within the spirit and scope of the invention as defined by the appended claims. Furthermore, in the following detailed description of the present invention, numerous specific details are set forth in order to more fully illustrate the present invention. However, it is apparent to one of ordinary skill in the prior art having the benefit of this disclosure that the present invention can be practiced without these specific details. In other instances, well-known methods and procedures, components and processes have not been described in detail so as not to unnecessarily obscure aspects of the present invention. It is, of course, appreciated that in the development of any such actual implementation, numerous implementation-specific decisions must be made in order to achieve the developer's specific goals, such as compliance with application and business related constraints, and that these specific goals vary from one implementation to another and from one developer to another. Moreover, it is appreciated that such a development effort can be complex and time-consuming, but is nevertheless a routine undertaking of engineering for those of ordinary skill in the art having the benefit of this disclosure.

Figure 1:
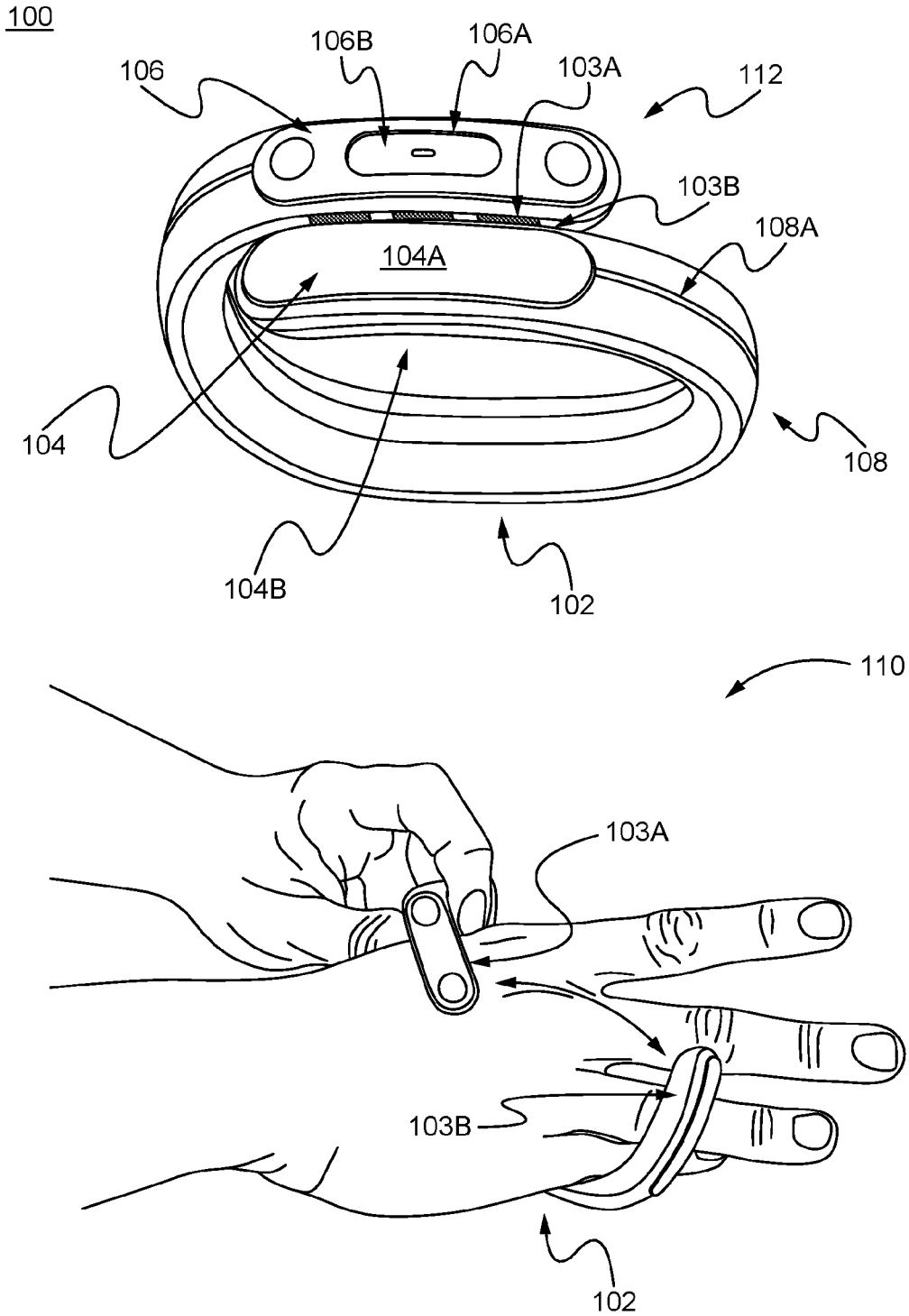
FIG. 1 illustrates a perspective view of a wearable electronic accessory device in accordance with some embodiments of the present invention.

FIG. 1 illustrates a perspective view of a wearable electronic accessory device 100 in accordance with some embodiments of the present invention. In some embodiments, the device 100 comprises a body 102 having a first side 104, a second side 106, and a connecting unit 108 connecting the first side 104 and the second side 106. Each of the first side 104 and the second side 106 contains a container. The container of the first side 104 is configured to have a structure to contain one or more earbuds. In some embodiments, the container of the first side 104 contains one or more cavities having a shape that is able to be snug-fit and immobilize the earbuds, so that the earbuds are retained and do not fall out when the cavities are facing toward the force of gravity. A cover 104A covers the cavities of the container at the first side 104. The cover 104A is able to be an earbuds housing cover. In some embodiments, the container of the second side 106 comprises a control unit 106A.

The device 100 comprises an elastic body 102, which can be pulled to open as in a wearing open state 110. In some embodiments, the elastic body 102 has a spring like function, allowing the elastic body 102 to spring back to a closed wearing state 112. In some embodiments, one or more magnets or materials that attract to a magnetic force are on the two sides 103A and 103B of the body to keep a loop shape of the body 102.

In some embodiments, the device 100 comprises a headphone including the earbuds, a cable, and the control unit 106A. The headphone is able to be a Bluetooth headphone.

In some embodiments, the device is formed as a bracelet having the body 102 in a loop structure. Two housing spaces 104B and 106B on the loop, one for storing the earbuds at the first side 104 and the other one for storing the control unit of the headphone at the second side 106. A slit 108A at the middle of the bracelet at the connecting unit 108 to store the cable of the headphone.

In some embodiments, electronic chips and batteries are embedded inside the loop structure of the body 102. The electronic chips are able to be used to track location, monitor movement, perform a Bluetooth connection, store music and data, and other functions by using GPS, memory storage unit, CPU, and other electronic hardware.

In some embodiments, the loop structure of the body 102 is able to have different designs. A person of ordinary skill in the art would appreciate that various appearances, shapes, colors, and materials can be used. For example, the body 102 can be made of materials such as rubber, metal, aluminum, gold, leather, and plastic. The device 100 is able to have various colors such as silver, black, red, blue, pink, and gold. The device 100 is able to have various shapes and designs such as, round, flat, thin, slim, rectangular, and other shapes. Similarly, the two housing spaces 104B and 106B for storing the earbuds and the control unit are able to be made using the above mentioned materials and made into a shape and color as mentioned above.

In some embodiments, the two housing spaces 104B and 106B are located at the top of the loop. In other embodiments, one or both of the two housing spaces 104B and 106B are located at different positions of the loop, for example, the bottom, the left side, or the right side.

In some embodiments, the housing cover 104A covers the housing space 104B for storing the earbuds. The housing cover 104A functions as a gate to store the earbuds inside the bracelet. The earbuds housing cover is able to be made into different designs, appearances, shapes, colors, and materials.

Figure 2:
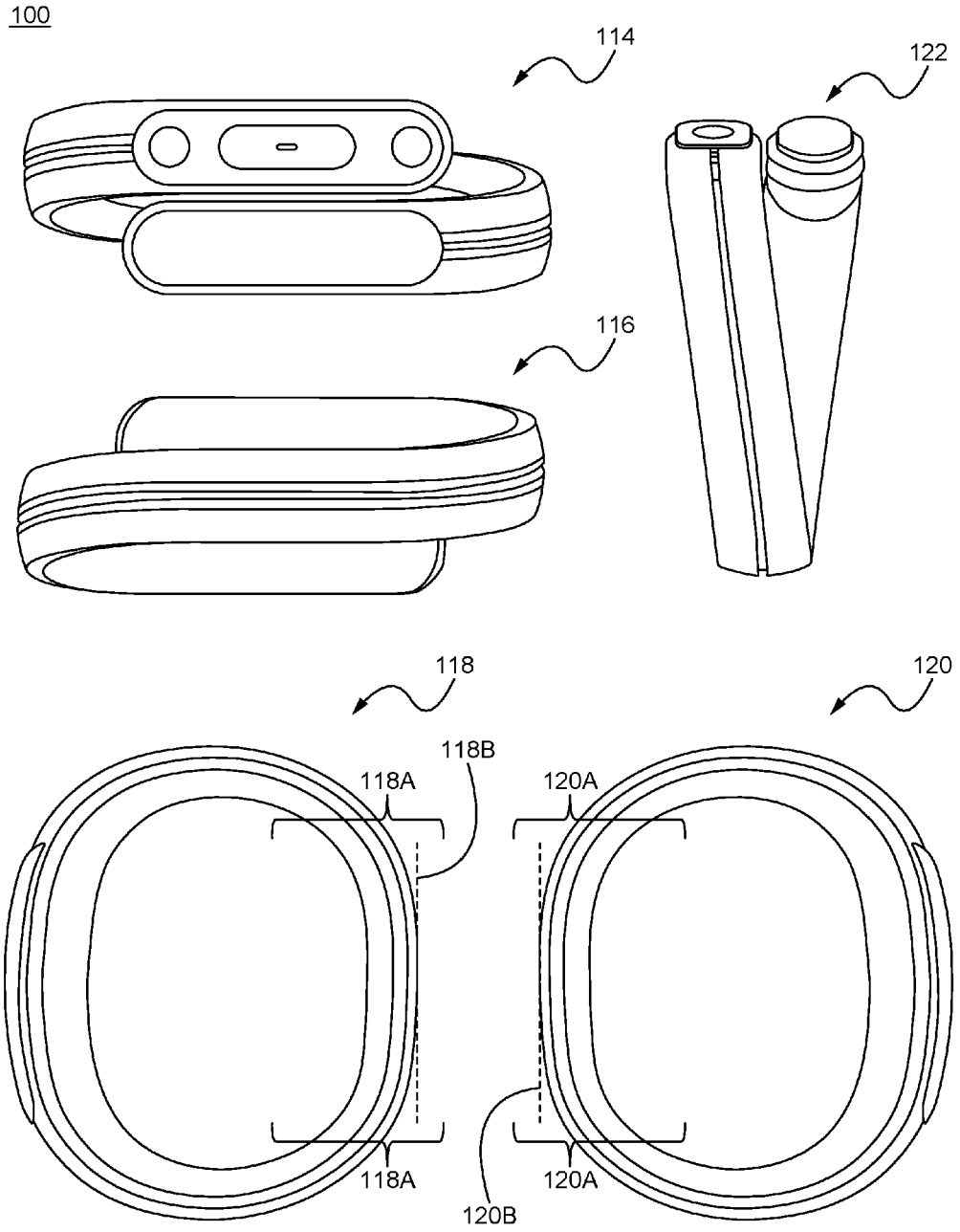
FIG. 2 illustrates several views of the wearable electronic accessory device in accordance with some embodiments of the present invention.

FIG. 2 illustrates several views of the wearable electronic accessory device 100 in accordance with some embodiments of the present invention. Item 114 shows a top view of the device 100, which shows that the two ends of the device 100 are coupled to each other and immobilized by its material property. Alternatively, the two ends of the device 100 are coupled to each other and immobilized by using a magnetic force. Item 116 shows a bottom view of the device 100. Item 118 shows a right side view of the device 100. The sections 118A and 120A comprise a thinness section or a reduced thickness of the loop to enhance the comfort to the user when wearing the device 100. In some embodiments, the sections 118A and 120A are substantially flat on a plane 118B and 120B such that the user is able to rest his/her wrist against a surface. Item 118 shows a right side view of the device 100. Item 120 shows a left side view of the device 100. Item 122 shows a front view of the device 100.

Figure 3:
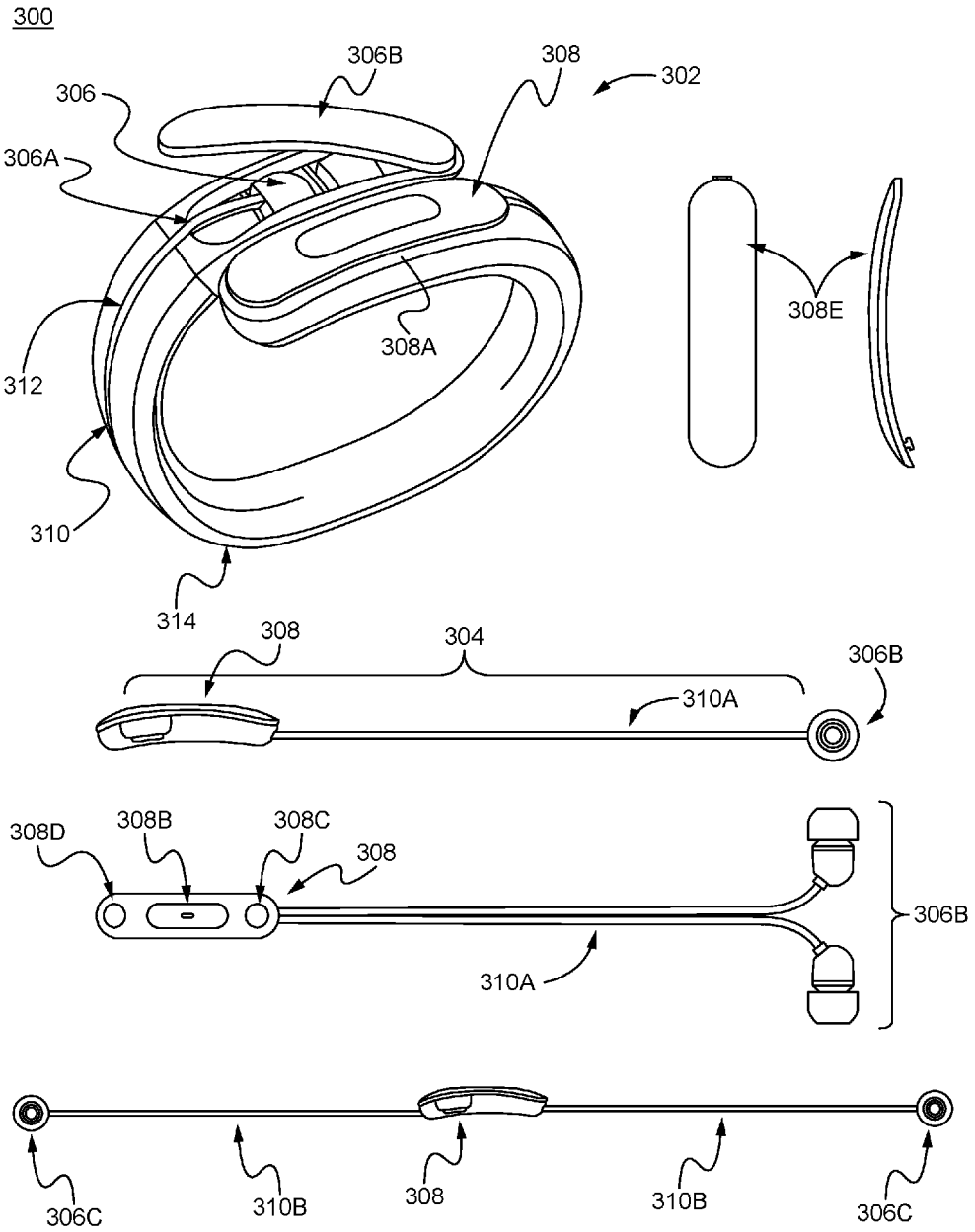
FIG. 3 illustrates constructions of the device in accordance with some embodiments of the present invention.

FIG. 3 illustrates constructions 300 of the device 100 in accordance with some embodiments of the present invention. Item 302 shows that a headphone 304 couples with a cuff 314, which is the same or similar construction of the body 102 in FIG. 1. The headphone 304 comprises a control unit 308 and one or more earbuds 306, which are coupled/connected via a cable 310. When the headphone 304 is stored in the cuff 314, two apertures 306A and 308A serve as housings for the earbuds 306 and the control unit 308, which are configured to be snug-fit inside the apertures 306A and 308A. The cable 310 is stored inside the slit 312. In some embodiments, the cable 310 is completely inside the slit 312, so that the cable 310 is invisible from outside. In some embodiments, the cable 310 comprises two parallel cables, which has one for a left channel volume and the other is for a right channel volume. A cover 308E conceals and covers the aperture 308A, which can be made of metal or metallic color. The cover 308E can comprise a bolt structure to be clipped on a hole on the cuff 314.

In some embodiments, two cables 310A are extending out from a same side of the control unit 308. In some other embodiments, two cables 310B are extending out from opposite sides of the control unit 308, such that the earbuds 306C are extending out at different directions, which can serve as a cable tangling prevention structure. A person of ordinary skilled in the art would appreciate that the cables 310 can be manufactured to come out of the control unit 308 in various directions.

In some embodiments, the headphone 304, which can be a Bluetooth headphone, has one control unit 308 and two earbuds 306. The two earbuds 306 are connected to the control unit 308 by two cables 310. The control unit 308 has electronic chips and batteries inside, such that the headphone 304 wirelessly connects to a music source device (such as a iPhone or a MP3 player) via Bluetooth. A person of ordinary skilled in the art would appreciate that the headphone 304 is able to connect with a music source device wirelessly or via another cable. In some embodiments, the headphone 304 is able to have different structures and be made of different materials. A person of ordinary skilled in the art would appreciate that various appearances, shapes, colors, and materials can be used. For example, the headphone 304 can be made of materials such as rubber, metal, aluminum, gold, leather, and plastic. The headphone 304 is able to have various colors such as silver, black, red, blue, pink, and gold. The headphone 304 is able to have various shapes and designs such as, round, flat, thin, slim, rectangular, and other shapes.

In some embodiments, the control unit 308 comprises one or more buttons. In some embodiments, a button 308B is used to turn on/off the power and/or the volume of the headphone 304. In some embodiments, the same button 308B is used to accept/reject phone call and pause/play music. In some embodiments, a button 308C is used to increase the volume. In some embodiments, the same button 308C is used to fast forward to the next song. Similarly, a button 308D is used to decrease the volume. In some embodiments, the same button 308D is used to fast rewind to the beginning of the current song and/or the previous song.

In some embodiments, each of the earbuds 306 has a speaker unit inside. In some embodiments, the earbuds 306 are able to have different structures and materials. A person of ordinary skilled in the art would appreciate that various appearances, shapes, colors, and materials can be used. For example, the earbuds 306 can be made of materials such as rubber, metal, aluminum, gold, leather, and plastic. The earbuds 306 are able to have various colors such as silver, black, red, blue, pink, and gold. The earbuds 306 are able to have various shapes and designs such as, round, flat, thin, slim, rectangular, and other shapes.

Figure 4:
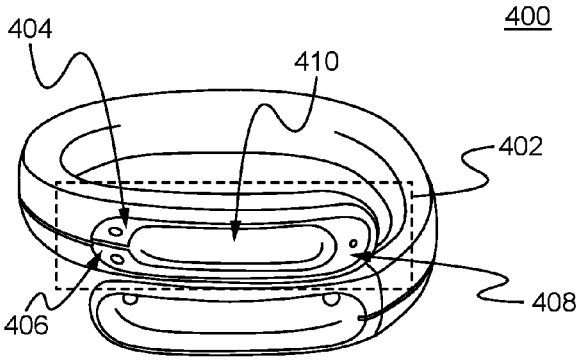
FIG. 4 illustrates a control unit in accordance with some embodiments of the present invention.

FIG. 4 illustrates a control unit 400 in accordance with some embodiments of the present invention. In some embodiments, the control unit 400 comprises a set of volume buttons 404 and 406 for volume control, a power control 408, and a biometrics identification device 410 such as a fingerprint scanner.

Figure 5:
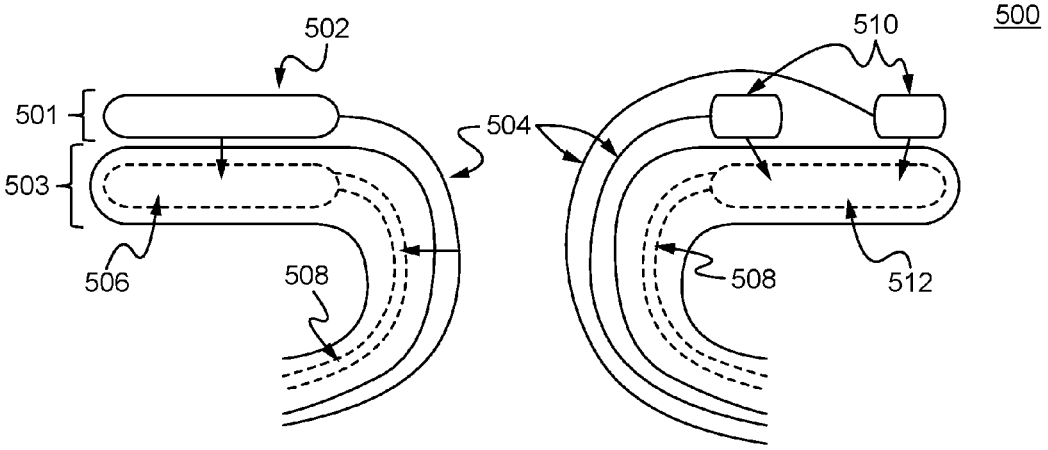
FIG. 5 illustrates a cross sectional view of a headphone storage inside a body of a cuff in accordance with some embodiments of the present invention.

FIG. 5 illustrates a cross sectional view of a headphone storage 500 inside a body of a cuff in accordance with some embodiments of the present invention. In some embodiments, the headphone 501 comprises a control unit 502 and earbuds 510 connected to the control unit 502 via a cable 504. The body of the cuff 503 comprises a first space 506 for storing the control unit 503, a second space 512 for storing the earbuds 510, and a channel 508 for storing the cable 504.

Figure 6:
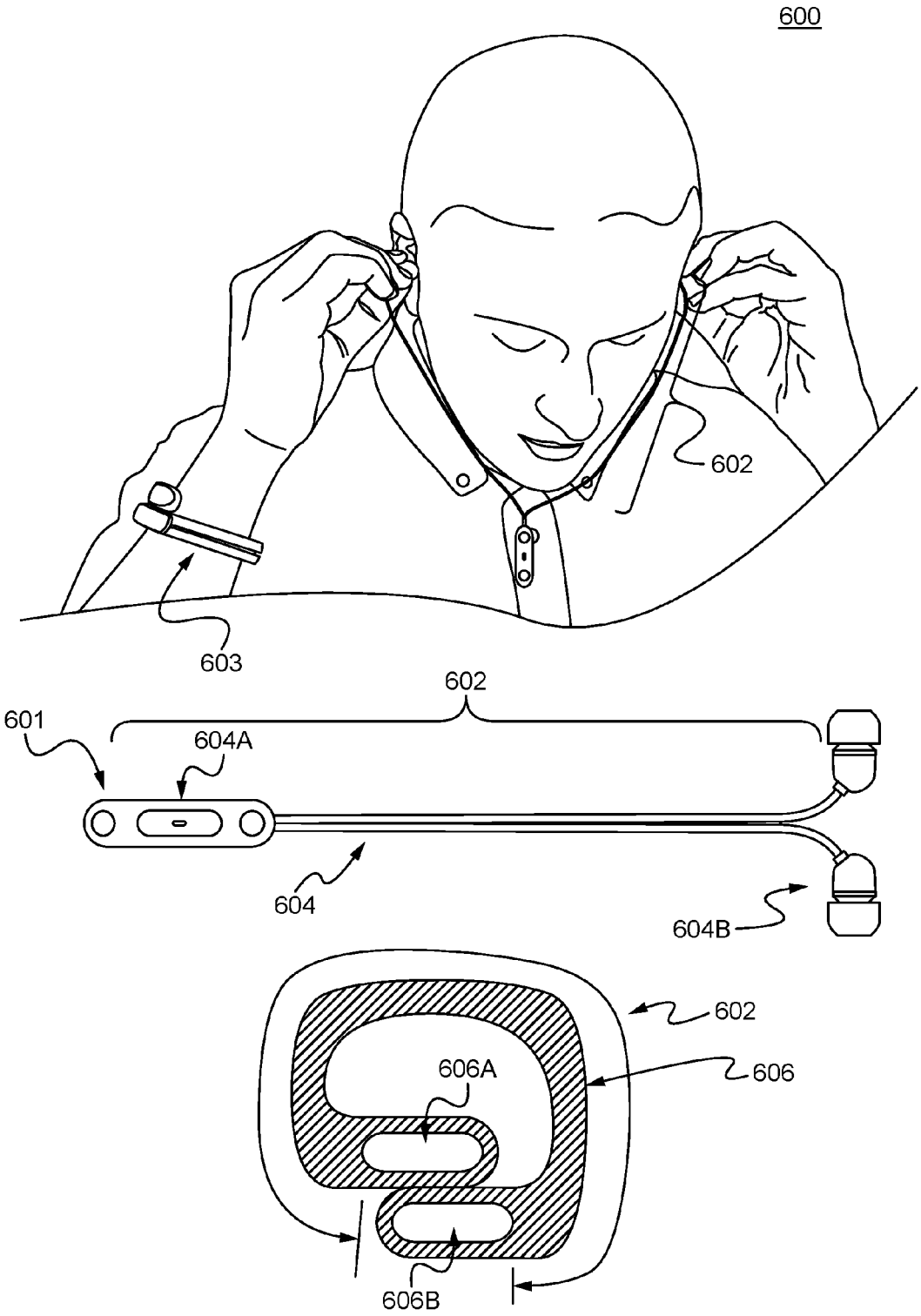
FIG. 6 illustrates a method of using the wearable electronic accessory device in accordance with some embodiments of the present invention.

FIG. 6 illustrates a method 600 for using the wearable electronic accessory device 100 in accordance with some embodiments of the present invention. A headphone 601 is able to be stored in the cuff 606 to be worn on a wrist 603. Similar to the device 100 (FIGS. 1 and 2) described above, the headphone 601 comprises a control unit 604A, a cable 604, and the earbuds 604B. The cable 604 has a length 602 long enough to hang under the chin and short enough to be stored in the cuff 606 (e.g., a bracelet). The control unit 604A can be stored in the first end 606A and the earbuds 604B can be stored in the second end 606B. In some embodiments, the length 602 is between 10 cm and 20 cm. In some embodiments, the length 602 is between 15 cm and 30 cm.

Figure 7:
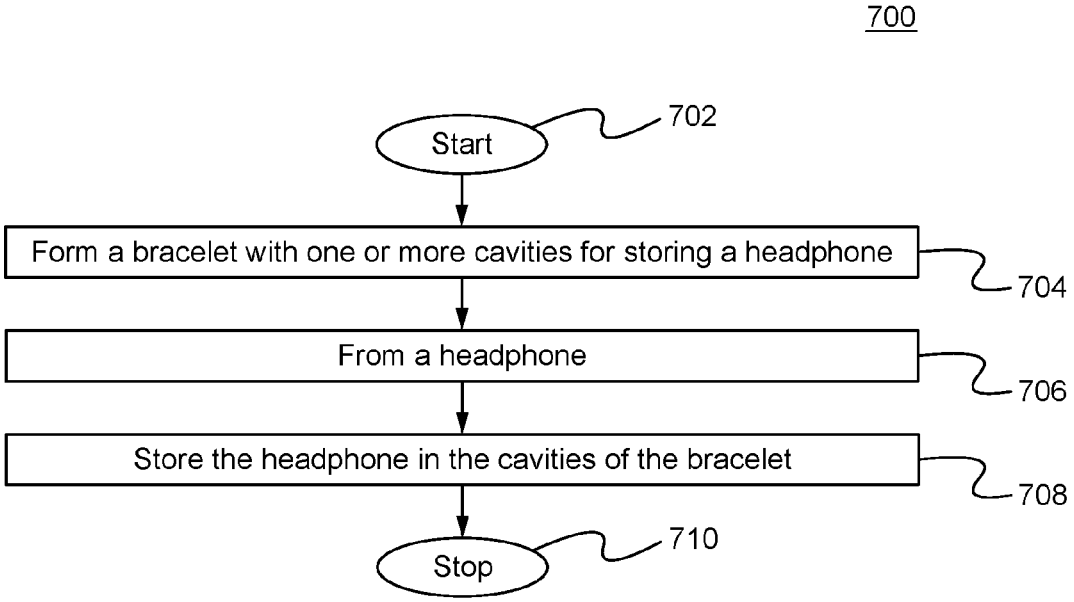
FIG. 7 illustrates a method of making a wireless headphone bracelet in accordance with some embodiments of the present invention.

FIG. 7 illustrates a method 700 of making a wireless headphone bracelet in accordance with some embodiments of the present invention. The method starts at a Step 702. At a Step 704, a bracelet is formed with one or more cavities having a shape configured to store a headphone. In some embodiments, the headphone comprises a wireless headphone. The headphone is able to contain a control unit, earbuds, and a cable connecting the control unit and the earbuds. The forming of the bracelet is able to be done by molding, CNC cutting and drilling, and other typical manufacturing methods and devices to make the bracelet. One or more covers for the cavities are formed. The cover is able to contain a ball joint structure to clip on a socket structure on or around the cavities, such that the cover is able to be fixed on the bracelet.

At a Step 706, a headphone is formed. In some embodiments, the headphone is structured to have a cable length long enough to be wore from one side of the ear under the chin to the other side of the ear and short enough to be stored inside the bracelet. In some embodiments, the length of the cable does not form a repeating loop when the headphone is stored inside the bracelet.

At a Step 708, the headphone is stored in the bracelet. In some embodiments, the control unit of the headphone is stored in a proximal side of the one of the cavities of the bracelet and the earbuds are stored at a distal side of the cavities of the bracelet. In some embodiments, the cavities for storing the earbuds are connected and form a number eight shape, such that each of the earbuds is able to be separately stored together. The method is able to stop at a Step 710.

In utilization, the bracelet, cuff, or a wrist wearable is able to be used as a container for the wireless headphone.

In operation, the headphone is placed into the bracelet, the control unit is placed in the associated housing space of the loop structure, the cables are placed into the channel and wrap around the bracelet, the earbuds are placed into the associated housing space on the loop structure of the bracelet, and the earbuds housing cover is closed.

In use, the earbuds housing cover is opened, the earbuds are taken out of the loop structure of the bracelet and the cables are taken out from the channel and unwrap around the bracelet, and the control unit is taken out of the loop structure of the bracelet.

The present invention has been described in terms of specific embodiments incorporating details to facilitate the understanding of principles of construction and operation of the invention. Such reference herein to specific embodiments and details thereof is not intended to limit the scope of the claims appended hereto. It is readily apparent to one skilled in the art that other various modifications can be made in the embodiment chosen for illustration without departing from the spirit and scope of the invention as defined by the claims.

What is claimed is:

1. A wireless headphone container comprising:

a. a bracelet; and b. a wireless headphone having earbuds, a controller, and one or more cables, wherein the earbuds are configured to fit into a first cavity at a first terminal end of the bracelet and the controller is configured to fit into a second cavity at a second terminal end of the bracelet that is opposite the first terminal end, wherein the earbuds and one or more cables are entirely separable from the bracelet, wherein the first terminal end comprises a first top portion having the first cavity for fitting the earbuds and a first side portion, and wherein the second terminal end comprises a second top portion having the second cavity for fitting the controller and a second side portion, wherein the first side portion of the first terminal end and the second side portion of the second terminal end are configured to magnetically couple with each other forming a wearable loop structure with an overlap portion.

2. The wireless headphone of claim 1, wherein the bracelet comprises a channel connecting the first cavity at the first terminal end and the second cavity at the second terminal end.

3. The wireless headphone of claim 2, wherein the channel is configured to have a size for storing a cable.

4. A wearable electronic device comprising:

a. a container wearable on a wrist; and b. an audio unit configured to be stored in the container, wherein the audio unit contains earbuds, a controller, and one or more cables, wherein the earbuds are configured to fit into a first cavity at a first terminal end of a bracelet and the controller is configured to fit into a second cavity at a second terminal end of the bracelet that is opposite the first terminal end, wherein the earbuds and one or more cables are entirely separable from a bracelet, wherein the first terminal end comprises a first top portion having the first cavity for fitting the earbuds and a first side portion, and wherein the second terminal end comprises a second top portion and a second side portion, wherein the first side portion of the first terminal end and the second side portion of the second terminal end are configured to magnetically couple with each other forming a wearable loop structure with an overlap portion.

5. The device of claim 4, wherein the audio unit comprises a headphone.

6. The device of claim 5, wherein the headphone comprises a Bluetooth headphone.

7. The device of claim 4, wherein the audio unit is stored inside the container, such that the audio unit is invisible when stored.

8. The device of claim 4, wherein the container comprises a bracelet.

9. The device of claim 4, wherein the wearable loop structure is able to be pulled to open.

10. A method of making a wearable headphone comprising:

a. forming a container wearable on a wrist;

b. forming a headphone with one or more connected cables, wherein the headphone comprises earbuds and a controller;

c. storing the earbuds in a first cavity of a first terminal end of the container and the controller in a second cavity of a second terminal end of the container, wherein the first terminal end is opposite to the second terminal end, wherein the headphone and one or more cables are entirely separable from the container; and d. forming a wearable loop structure with an overlap portion by magnetically coupling a first side portion of the first terminal end and a second side portion of the second terminal end.

11. The method of claim 10, further comprising forming at least two cavities and a slit across the wearable loop structure on the container.

12. The method of claim 11, wherein the slit has a shape for storing an audio cable.

* * * * *